United States Patent [19]

Campbell

[11] 3,949,481

[45] Apr. 13, 1976

[54] LAYOUT INSTRUMENT FOR SHEET-MATERIAL FABRICATION

[75] Inventor: Marcus E. Campbell, Cincinnati, Ohio

[73] Assignee: Joseph L. Kresser, Newtown, Ohio ; a part interest

[22] Filed: Sept. 30, 1974

[21] Appl. No.: 510,447

[52] U.S. Cl. ..... 33/75 R; 33/79 R; 33/102; 33/174 N

[51] Int. Cl.[2] ..... B43L 7/06; G01B/3/14

[58] Field of Search ..... 33/75 R, 79 R, 33/102, 174 N, 174 F, 4

[56] References Cited

UNITED STATES PATENTS

| | | | |
|---|---|---|---|
| 380,360 | 4/1888 | Spencer et al. | 33/102 |
| 678,018 | 7/1901 | McFarland | 33/75 R |
| 749,921 | 1/1904 | Davidson | 33/75 R |
| 2,327,058 | 8/1943 | O'Keefe | 33/75 R |
| 3,131,478 | 5/1964 | Snurr | 33/79 R |
| 3,159,919 | 12/1964 | Brunell | 33/79 R |

*Primary Examiner*—Richard E. Aegerter
*Assistant Examiner*—Willis Little
*Attorney, Agent, or Firm*—J. Warren Kinney, Jr.

[57] ABSTRACT

A layout instrument for constructing the two-dimensional sheet pattern which defines a cylindrical article having longitudinal elements of varying lengths, each of which are parallel to the axis of the cylinder, wherein an oblique plane passes through the cylinder and intersects the base plane thereof at an acute angle. The instrument comprises a calibrated miter scale having a series of equally spaced subdivisions which establish the length of the longest and shortest elements of the cylindrical article and a calibrated layout scale having a series of spaced points each of which establishes the length of one of a plurality of specific, circumferentially spaced elements of the cylindrical article.

7 Claims, 18 Drawing Figures

LAYOUT INSTRUMENT FOR SHEET-MATERIAL FABRICATION

BACKGROUND OF THE INVENTION

1. Field of the Invention

The present invention is related to the apparatus for constructing cylindrical articles from a flat piece of sheet material, and provides means for constructing a pattern having parallel, opposite seam-defining edges connected by a curved end edge, wherein the seam-defining edges are adapted to be placed in abutting relationship with one another to define a cylindrical article having longitudinal elements of varying length, each of which are parallel to the axis of the cylinder, and wherein the curved end-edge of the pattern defines an oblique plane which passes through the cylinder and intersects the base plane thereof at an acute angle.

2. Description of the Prior Art

Generally, solids fall into three broadly defined classes: (1) those having parallel longitudinal elements, such as cylinders, rectangular prisms and the like; (2) those having radial longitudinal elelments, each of which intersect at a common point or vertex, such as cones, pyramids and the like; and (3) those having both parallel and radial elements, generally referred to as irregular solids.

Articles such as hollow, tubular ducts and the like, have outer surfaces or boundaries which define solids and therefore, may be categorized as falling into one of these classified cations. The articles may, in general, be fabricated from two-dimensional sheet patterns which are laid-out upon flat pieces of formable material such as sheet metal and the like.

Over the years three distinct methods have been developed for constructing the two-dimensional sheet patterns which, when assembled, define said articles. The first method is referred to as parallel line development and is useful in constructing sheet patterns of articles having parallel longitudinal elements. The second method is referred to as radial line development and is useful in constructing sheet patterns of articles having radial longitudinal elements. The third method, triangulation, is a general method of construction and may be utilized to construct sheet patterns for any article having at least one straight element extending the full length thereof. Generally, triangulation is limited to use in construction of patterns for articles which are classified as irregular solids. Each of these methods requires the projection of the "true length" of various elements of the article onto an "unrolled" or flat surface of sheet material which, when assembled, defines the outer surface of the article. Each of the required number of elements must be separately and precisely projected onto the pattern piece if an accurate article is to be constructed. A complete disclosure of each of these methods is found in: *Elements of Sheet-Metal Work*, chapters 4–6, by W. Cookson and A. Bold, published by Frederick J. Drake and Co., Chicago, Ill., 1939.

Further, it has been found that the sheet pattern for a two-piece, right-angle cylindrical elbow having pieces which intersect at a 45° angle may be accurately developed utilizing the particular mathematical relationship derived from the specific geometric configuration thereof. Specifically, a circular cross-section of the elbow is subdivided into a plurality of equal sectors, each of which intersects the diameter at a specific angle "$a_n$". The stretch-out "S" is derived from:

$$S = \pi D,$$

where "$D$" is the diameter of the circular cross-section. A line equal in length to the stretch-out $S$ is constructed on a sheet of pattern material and is subdivided by lines normal thereto into a number of equal segments corresponding to the number of sectors of the circular cross-section. The curve which defines the plane of intersection of the elbow pieces is then constructed by determining those points on the curve which fall on the normal lines, wherein:

$$d_n = D/2(1\text{-SIN}a_n),$$

wherein $d$ equals the distance along a specific normal line $n$ from the stretch-out line to the point on the curve. This method is fully disclosed in: *Sheet Metal Pattern Layouts*, pages 1021–1023, by Edwin P. Anderson, published by Theodore Audel and Co., New York, N.Y., 1965 (1969 printing).

While each of these methods produces a pattern which is generally of sufficient accuracy to fabricate a satisfactory article of the specific type described, it will be noted that the entire process must be repeated each time at least one dimension of the final article is altered.

SUMMARY OF THE INVENTION

I have discovered that a general layout instrument for developing the two-dimensional sheet pattern for any cylindrical article may be constructed from certain of the mathematical relationships which are inherent in the general geometric configuration thereof. In this regard, each of the following statements is assumed to be true for any article which defines a cylinder having an oblique plane passing therethrough and intersecting the base plane at an acute angle, to wit:

1. The (real or imaginary) base plane of each article is normal to each of the various elements of the article;
2. Miter angle $b$ is the included angle between the oblique plane and the base plane of the article;
3. The mouth diameter D is the diameter of the base plane cross-section;
4. The miter height V is the length of the longest longitudinal element of the article less the length of the shortest longitudinal element of the article;
5. The radius R of the article is the radius of an arc which defines the geometric centerline of the article and is the distance between the intersection of the axis of the cylinder and base plane and the intersection of the oblique plane and base plane;
6. Each sector angle $a_n$ is the included angle between the axial plane of each element n of the article and the axial plane of an arbitrary, predetermined initial element thereof; and
7. The stretch-out S is equal to the circumference of the article and is determined by the following relationship:

$$S = \pi D.$$

The layout instrument of the present invention comprises a universal layout scale and generally, one of a plurality of specific, limited range miter scales. Each specific miter scale comprises a series of equally spaced subdivisions which define the miter height V in terms of the diameter D and radius R of the article, and therefore, establishes the relative length of the longest and shortest elements thereof. The universal layout scale comprises a series of spaced, calibrated points which define the length of each of the various elements of the article by establishing specific points on the curved edge of the sheet pattern.

It should, of course, be understood the accuracy of the derived pattern is directly dependent upon the number of elements accurately defined by the layout scale. In practice, patterns of 12, 24, and 48 elements are common and require layout scales of 7, 13 and 25 points, respectively. The teachings of the present invention permit the manufacture of a layout scale having any desired number of points.

In use of the instrument, it is only necessary to calculate the stretch-out S of the article, construct a line equal thereto and subdivide said line into a number of equal segments corresponding to the number of calibrated points on the layout scale. The actual height of the pattern and the miter height V are then established relative to the stretch-out line by selecting and utilizing the specific miter scale of the instrument as determined by the desired miter angle *b* of the article.

While the present invention is useful for constructing a sheet pattern for any cylindrical article having parallel longitudinal elements, the detailed description which follows demonstrates use of the instrument in constructing the pattern for a typical, five-piece, right-angle elbow having a miter angle *b* of 11.25°. The particular miter scale of this example may, of course, be utilized to construct the pattern for any article having a like miter angle.

It is, therefore, a primary object of the present invention to provide a layout instrument for use in construction of sheet patterns for cylindrical articles of the type having longitudinal elements of varying length.

It is, further, an object of the present invention to provide an instrument and method which enables one not having particular or special sheet-working skills to construct a sheet pattern for articles of the type described.

It is, also, an object of the present invention to provide a layout instrument for and method of efficiently and economically constructing accurate two-dimensional sheet patterns of cylindrical articles.

While certain advantages and features of the invention have been described and illustrated in the drawings and description which follow, it should be understood that such are not intended to limit the scope and spirit of the invention as defined by the claims appended hereto.

DESCRIPTION OF THE PREFERRED EMBODIMENTS

Figures 1, 2, 3, 4, 5, 6, 7, 8, 9, 10:
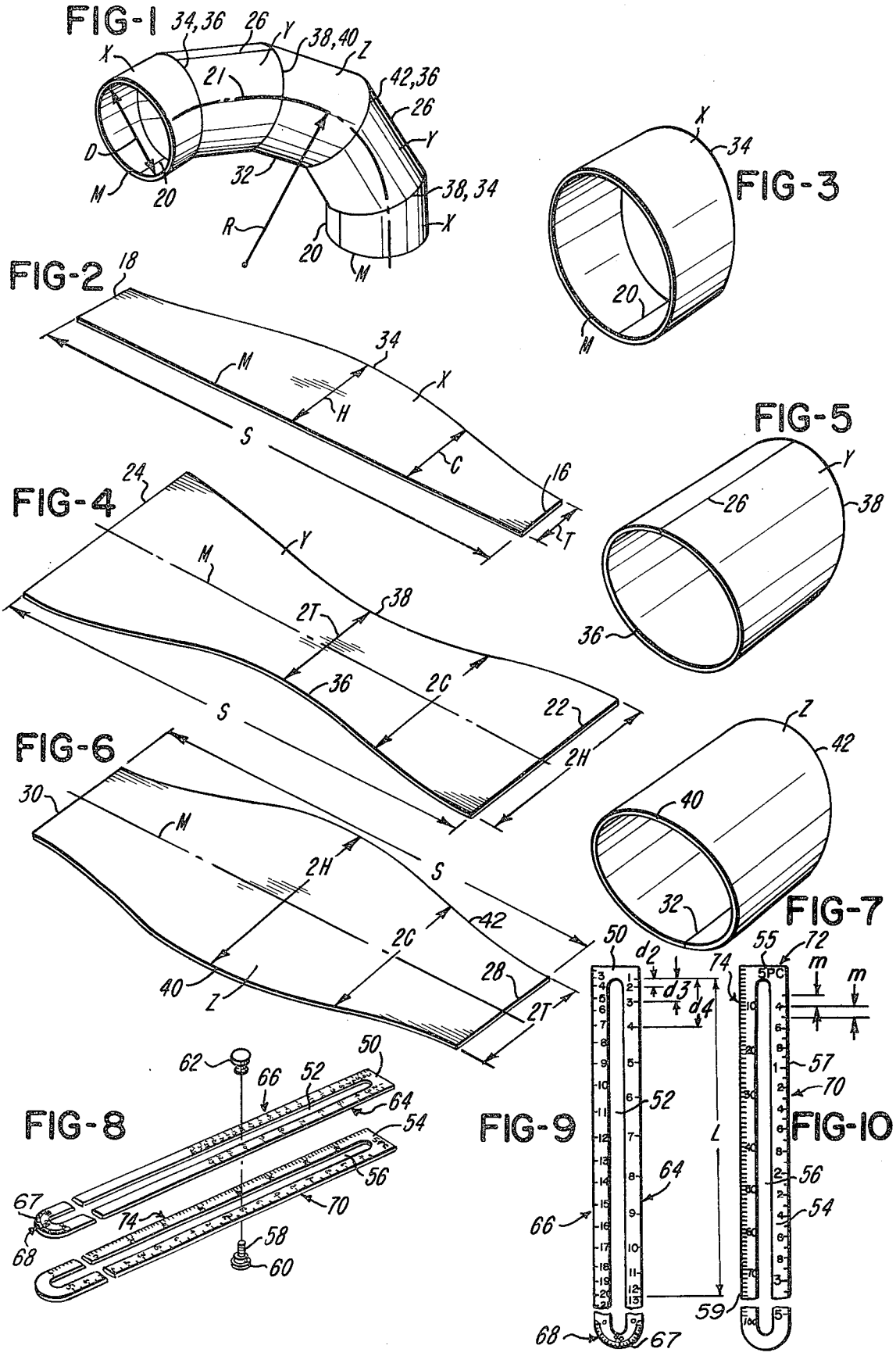
FIG. 1 is a perspective view of a five-piece, right-angle elbow.
FIG. 2 is a perspective view of an unrolled convex end-gore.
FIG. 3 is a perspective view of the assembled elbow section generated from the end-gore of FIG. 2.
FIG. 4 is a perspective view of an unrolled concave intermediate-gore.
FIG. 5 is a perspective view of the assembled elbow section generated from the intermediate-gore of FIG. 4.
FIG. 6 is a perspective view of an unrolled convex central-gore.
FIG. 7 is a perspective view of the assembled elbow section generated from the central-gore of FIG. 6.
FIG. 8 is an exploded view of the layout instrument of the present invention, illustrating the interrelationship of the various components thereof.
FIG. 9 is an elevational view of the layout scale of FIG. 8, enlarged for clarity of detail and understanding.
FIG. 10 is an elevational view of the miter scale of FIG. 8, enlarged for clarity of detail and understanding.

A typical five-piece, right-angle elbow and the assembly therefor are illustrated in FIGS. 1–7. The elbow comprises a pair of convex end-gores X,X, a pair of concave intermediate-gores Y,Y and a convex central-gore Z. As illustrated in FIGS. 2, 4 and 6, each gore is constructed from a flat piece of sheet material, wherein each end-gore (FIG. 2) comprises a "half" gore having side edges defined by curved edge 34 and straight edge "M", and wherein each intermediate-gore (FIG. 4) and the central-gore (FIG. 6) comprises "full" gores having side edges defined by curved edges 36, 38 and 40,42, respectively. Line or edge M of each gore corresponds to the base plane thereof when each gore is rolled and assembled as illustrated in FIGS. 3, 5 and 7. Each full gore is symmetrical about line M and therefore defines a pair of interconnected, mirror-image, half gores.

It should, of course, be understood that concave and convex gores may be utilized interchangeably, the particular selection being generally dependent upon conservation of material and effort in construction of the elbow. Each of the gores is of length S, which is the stretch-out of the elbow. The stretch-out is equal to the circumference of the base-plane crosssection of the elbow, and may be derived from the diameter D of the mouth of the elbow (FIG. 1). Radius R is the radius of the arc defined by the geometric centerline 21 of the elbow. As particularly illustrated in FIG. 14, the radius R may be established by determining the length of line 23 which extends from the intersection 25 of axis A of the cylinder and base-plane M to the intersection 27 of oblique plane J and the base-plane. Curved edges 34, 36, 38, 40 and 42; heel H and throat T and center height C of each gore are established by the diameter D, radius R, the number of elbow pieces, and the included angle *s* between the opposite mouths or ends of the elbow. It should, of course, be understood that each full gore Y,Y and Z is twice the corresponding half gore X and therefore has a throat 2T, heel 2H and center height 2C.

After the unrolled gores of FIGS. 2, 4 and 6 are constructed, the respective seam-defining edges thereof are placed in abutting relationship with one another and suitably interconnected to form a permanent seam, thereby generating the cylindrical article which corresponds to the elbow sections illustrated in FIGS. 3, 5 and 7, respectively. Specifically, seam-defining edges 16 and 18 of each end-gore X are joined to form seam 20 (FIG. 3), seam-defining edges 22 and 24 of each intermediate-gore Y are joined to form seam 26 (FIG. 5), and seam-defining edges 28 and 30 of central-gore Z are joined to form seam 32 (FIG. 7). The curved edges 34, 36, 38, 40 and 42 of the elbow sections are then disposed in abutting relationship with and suitably secured to one another to fabricate the five-piece, right-angle elbow illustrated in FIG. 1.

The layout instrument of the present invention is illustrated in FIG. 8 and provides dependable means for economically and efficiently generating the pattern pieces which collectively define a multi-section article such as the elbow illustrated in FIG. 1. The instrument comprises, in general, a universal layout scale bar 50 having an elongate central slot or channel 52 and a miter scale bar 54 having elongate central slot or channel 56. Bars 50 and 54 are adapted to be secured in fixed angular relationship with one another by means of screw 58 and nut 62, wherein the annular shoulder 60 of the screw is adapted to form a snug, slip-fit relationship with the side walls of channels 52 and 56 when inserted therein.

The elongate layout scale bar 50 is illustrated in FIG. 9 and includes a pair of opposite, spaced, parallel, longitudinal edges 64 and 66, each of which include a calibrated layout scale defined by a series of spaced points 1–13 and 1–25, respectively. Scale 1–13 defines the points on a curve pattern for a 24 element approximation of the cylindrical article, whereas scale 1–25 defines the points on a curved pattern for a forty-eight element approximation of the cylindrical article. It will be readily apparent from the description which follows that a layout scale having any desired number of spaced, calibrated points may be constructed using the teachings of the present invention. Where desired, a protractor scale 67 may be included at the outer edge of the arcuate end 68 of bar 50.

The elongate miter scale bar 54 is illustrated in detail in FIG. 10 and includes a series of calibrated, equally spaced subdivisions 70 extending along one longitudinal side edge 57 thereof. The zero point of the miter scale is at end-edge 55 of scale bar 54, which is normal to edge 57. the specific miter scale illustrated is utilized to generate a 5-piece (5-PC) right-angle elbow such as that illustrated in FIG. 1, i.e. a cylindrical article having a miter angle *b* of 11.25°. It is, of course, desirable to provide each particular miter scale with identifying indicia 72, thus enabling the user to readily determine and select the proper miter scale for each article. It will be readily apparent from the description which follows that a miter scale for any solid article comprising a specific predetermined miter angle *b* may be constructed utilizing the teachings of the present invention. Where desired, a general purpose scale such as decimal rule 74 may be included at opposite side edge 59 of scale bar 54.

Figure 11:
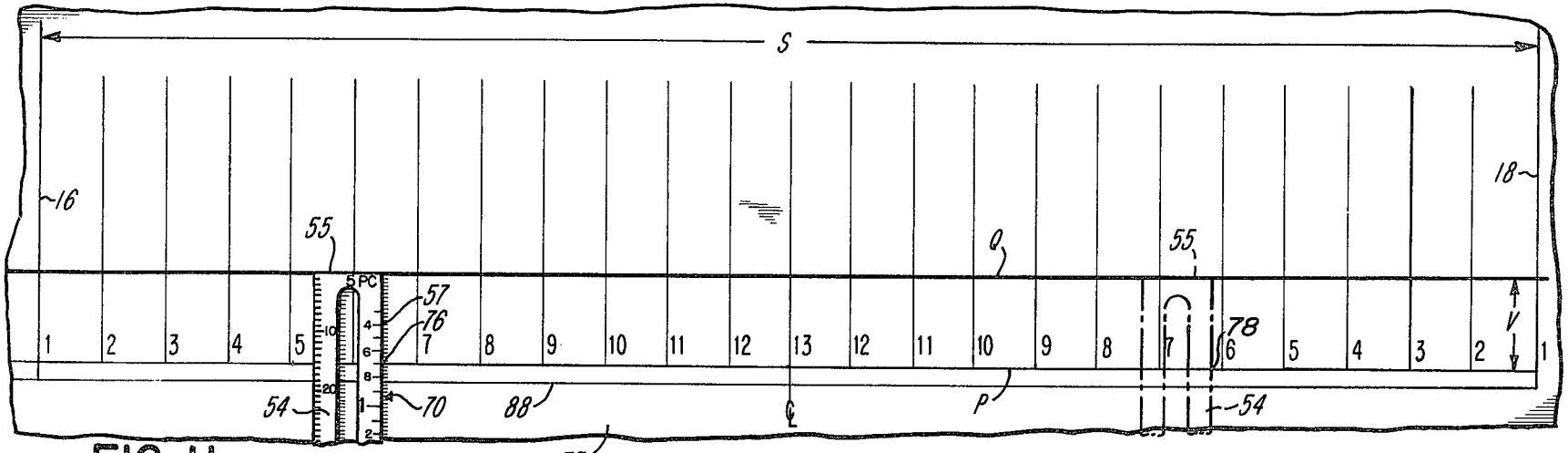
FIGS. 11–13 illustrate various steps in the method of generating the unrolled convex end-gore of FIG. 2, utilizing the layout instrument and methods of the present invention.
Figure 12:
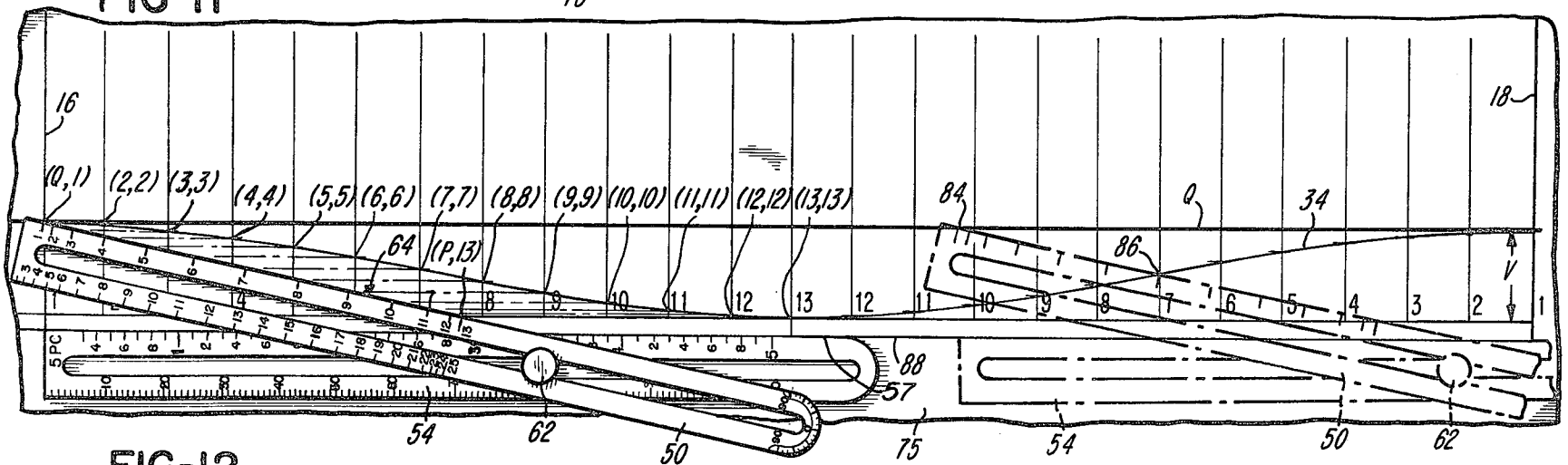
Figure 13:
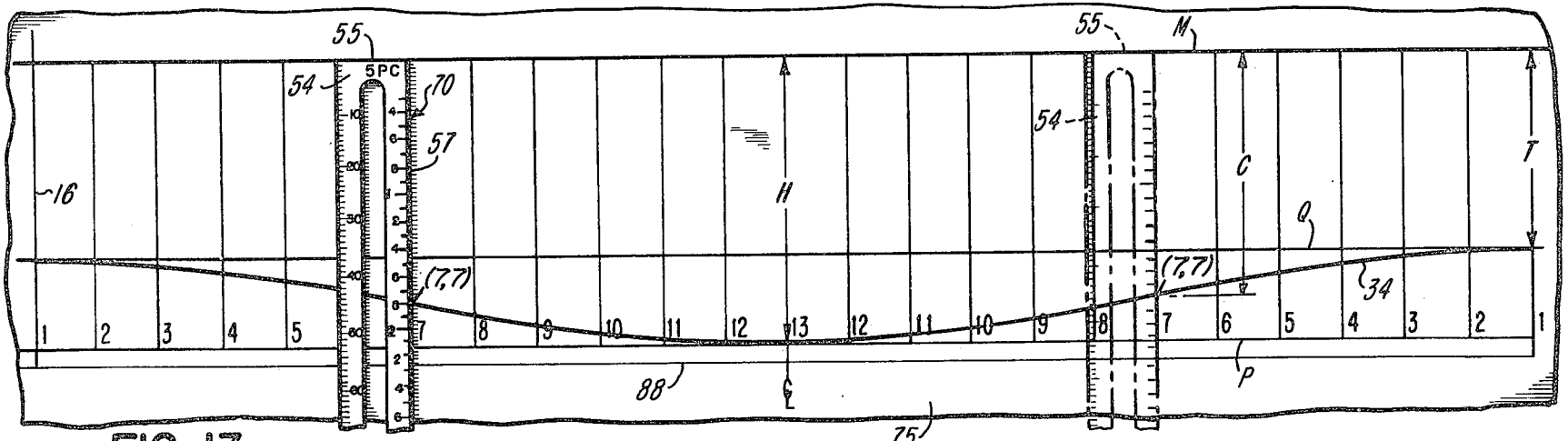

FIGS. 11–13 illustrate a method of constructing the unrolled convex end-gore X of the elbow illustrated in FIG. 1 using the layout instrument of the present invention. It should, of course, be understood that each of the gores illustrated in FIGS. 1–7 may be constructed in a similar manner. Particularly, the full gores illustrated in FIGS. 4 and 6 are constructed by utilizing the procedure which follows wherein the identical pattern is repeated on either side of line M. It will be readily apparent from the method here disclosed that either a concave or convex gore pattern may be generated by utilizing the layout instrument and methods of the present invention.

By way of example, it will be assumed that the five-piece, right-angle elbow of FIG. 1 has a mouth diameter D of seven inches and a radius R of 18 inches. In order to determine the stretch-out length of S of the elbow, it will be noted that S is the circumference of the base-plane of the elbow and therefore:

$S = \pi D$, and where $D = 7$ inches, $S = \pi(7) = 22$ inches.

It is next necessary to determine the length of the longest element of the article in order to select a sheet of pattern material which will readily accommodate the unrolled gore. Heel H is the maximum height of the pattern and corresponds to the length of the longest element. The miter scale of the present invention is sequentially numbered such that heel H is defined by the number of subdivisions thereof which equal the radius R of the article plus one-half the diameter D thereof, to wit:

$$H = R + \tfrac{1}{2}D = 18 + \tfrac{1}{2}(7) = 21\tfrac{1}{2}.$$

A piece of flat sheet material 75 which is of a size sufficient to readily accommodate the stretch-out S and the heel H of the end-gore is selected, and horizontal trim line 88 is arbitrarily constructed on the surface thereof. Line P is provided parallel to and slightly above line 88 and defines the base pattern line of the gore. Centerline ℄ is provided near the center of sheet 75 and normal to lines P and 88. Line P is then subdivided into twenty-four equal segments by lines 1—1-3—1 normal thereto, the collective length of which equals the stretch-out S of the gore, wherein the opposite end-lines 1, 1 conform to the seam-defining edges 16 and 18.

Miter scale bar 54 is placed on the surface of sheet 75 with edge 57 parallel to lines 1—13—1, and miter height V is established by locating the subdivision thereon which is identified by the absolute value of diameter D. Therefore, in the present example, the miter height has a miter scale value of seven. Point 7 is located on scale 70 and is placed in coinciding relationship with base pattern line P as illustrated at 76, wherein edge 55 or the zero point on the miter scale 54 defines the upper pattern line Q of the gore. As illustrated in phantom, this procedure may be repeated at 78 to provide two marks from which the line Q may be easily constructed.

It will be noted that throat T corresponds to the length of the shortest element of gore X and is defined by the following relationship:

$$T = H - V.$$

Therefore, both the shortest element T and the longest element H of the gore are readily established by the miter scale of the present invention, wherein:

$$H = R + \tfrac{1}{2}D,$$

$V = D$, and $T = H - V = (R + \frac{1}{2}D) - D = R\frac{1}{2}D.$

After lines 1—13—1, and lines 88, P and Q have been provided on sheet 75, the layout scale bar 50 and the miter scale bar 54 are assembled as illustrated in FIG. 12, wherein edge 64 of the layout scale bar is placed such that point 1 of the scale is in coinciding relationship with intersection (Q,1) of lines Q and 1, and point 13 of the scale is placed at (P,13) in coinciding relationship with line P. Edge 57 of miter scale bar 54 is placed parallel to and adjacent line 88, and nut 62 is tightened to maintain a fixed angular relationship between bars 50 and 54. The horizontal phantom lines which project from points 2–13 on scale bar 50 diagrammatically illustrate the intersections (2,2)–(13,13) of each point 2–13 of the layout scale with the corresponding segment defining lines 2–13 on pattern sheet 75. Each intersection defines one point on the curved edge 34 of gore X. A smooth curve may be drawn through each of these points, wherein the curve defines a 24 element approximation of the curved edge face 34 of the gore (FIG. 13).

Utilizing the miter scale of the present invention, the average or center height C may be found be locating the subdivision on miter scale 70 which corresponds to the absolute value of radius R. Therefore, in the present example the center height C has an absolute value of eighteen. Subdivision 18 is located on the miter scale and placed at intersection (7,7), see FIG. 13, wherein edge 55 of the scale bar defines the location of line M. Line M defines the base plane of the gore and establishes the full length of each of the elements thereof. End-gore X is bounded by line M, curve 34, and seam-defining edges 16,18 (normal lines 1, 1). Throat T is the length of the shortest element, heel H is the length of the longest element, and center height C is the average height of the gore, wherein the throat, heel and center height may be readily determined from the miter scale of the present invention, to wit:

$T = R - \frac{1}{2}D,$ $H = R + \frac{1}{2}D$, and $C = R.$

It should, of course, be understood that each of the various gores of the elbow of FIG. 1 may be generated by utilizing the above procedure. The full gores Y and Z will, of course, comprise identical patterns on either side of line M, and the normal lines of the concave gores will, of course, be designated 13—1—13 instead of 1—13—1 as illustrated in FIGS. 11–13.

Figure 14:
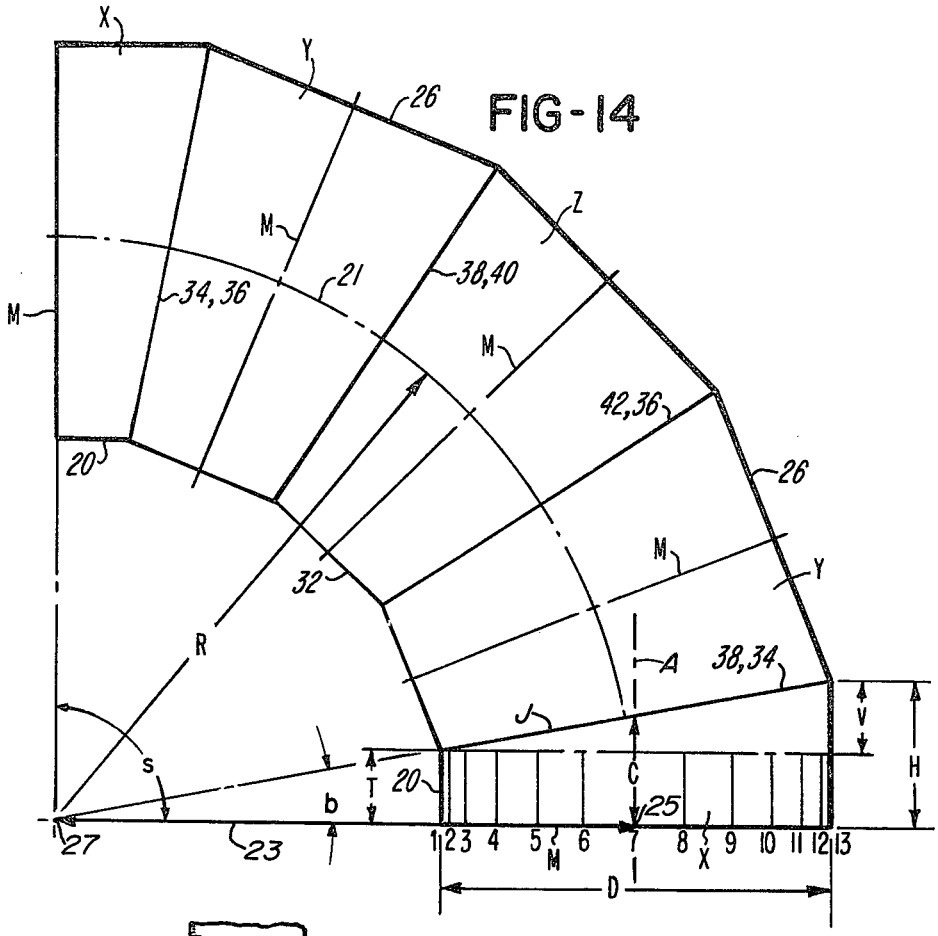
FIG. 14 is a side view of FIG. 1 and illustrates in detail the relationship utilized in deriving the miter scale of the present invention.
Figure 15:
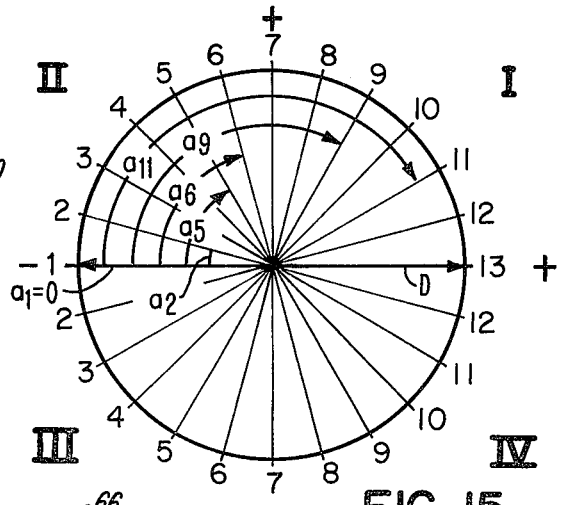
FIG. 15 is a base plane cross-section of the elbow of FIG. 1, subdivided into twenty-four equal sectors, and illustrating in detail the relationship utilized in deriving the layout scale of the present invention.

FIGS. 14 and 15 are the side view and the base-plane cross-section, respectively, of a five-piece, right-angle elbow and illustrate the geometric and mathematical relationships from which the calibrated layout scale 1–13 and the 5–PC calibrated miter scale 70 of FIGS. 9 and 10 are constructed.

It will be readily apparent from the drawings that a five-piece, right-angle elbow includes four pairs of abutting oblique planes as defined by end-faces 34,36; 38,40; 42,36 and 38,34 of gores X-Y, Y-Z, Z-Y and Y-X, respectively. Therefore, the elbow has eight mitered edges each of which are defined by an oblique plane J passing through the cylinder and intersecting the adjacent base-plane M at an angle $b$. The miter scale may be derived from the miter angle $b$ utilizing the following mathematical relationship, to wit:

$m = (\mathrm{TAN}b)k$, where $k$ = one unit of linear measure, and where $m$ is the length of each subdivision of the miter scale.

As illustrated in FIG. 10, the zero point of a 5-PC miter scale 70 coincides with end-edge 55 of scale bar 54, and each of the remaining points of the 5-PC miter scale are separated from the adjacent points by a distance $m$.

The length $m$ of each subdivision of the miter scale for the elbow of the above example, wherein all dimensions are given in inches, is as follows:

$b = (90/8)° = 11.25°$ $m = (\mathrm{TAN}b)k = [\mathrm{TAN}(11.25)](1 \text{ inch})$ $= 0.1989$ inches It should, of course, be understood that a miter scale for an elbow comprising any desired number of sections or pieces may be generated in a similar manner, wherein:

$b$ = miter angle, i.e. included angle between oblique plane J and base-plane M, and $m = (\mathrm{TAN}b)k$ = length of each subdivision of miter scale.

The calibrated layout scale of FIG. 9 is derived from the following mathematical relationship:

$d_n = L[1 + \mathrm{COS}(a_n)[$, wherein $n$ = number of each segment defining normal line, $L$ = length of layout scale, $d$ = distance of each point on layout scale from one end thereof, corresponding to a particular normal line $n$, and $a_n$ = angle at which the axial plane of each element corresponding to a normal line $n$ intersects the axial plane of a predetermined diameter of the cylindrical article.

The thirteen-point calibrated layout scale 1–13 of FIG. 9 is constructed from the specific relationship illustrated in FIG. 15, wherein a base-plane cross-section of the elbow is separated into twenty-four identical sectors bounded by a plurality of radial lines which define the axial planes of the various elements 1—1-3—1. Angle $a_n$ is the included angle between each plane and the axial plane which defines diameter D, wherein the angle $a_1$ equals zero and each of the successive angles $a_2$–$a_{13}$ are in fifteen-degree increments therefrom. It will be noted from the drawings that an orthogonal relationship prevails, wherein angles $a_1$–$a_6$ are in quadrants II or IV and have negative cosines, and wherein angles $a_8$–$a_{13}$ are in quadrants I or III and have positive cosines. The cosine of each transition angle $a_7$ is, of course, zero.

As shown in FIG. 9, point 1 is arbitrarily placed on scale bar 50, and each succeeding point is measured therefrom. Table I illustrates the derivation of a 13-point layout scale having an overall, effective scale length of 6 inches, i.e., L = 6 inches.

TABLE I

| "$a_n$" | "$1+COSa_n$" | $d_n = ½L(1+COSa_n)$ |
|---|---|---|
| $a_1$ = 0° | 0.0000 | $d_1$ = 0.0000 inches |
| $a_2$ = 15° | 0.0341 | $d_2$ = 0.1023 inches |
| $a_3$ = 30° | 0.1340 | $d_3$ = 0.4020 inches |
| $a_4$ = 45° | 0.2929 | $d_4$ =0.8787 inches |
| $a_5$ = 60° | 0.5000 | $d_5$ = 1.5000 inches |
| $a_6$ = 75° | 0.7412 | $d_6$ = 2.2236 inches |
| $a_7$ = 90° | 1.0000 | $d_7$ = 3.0000 inches |
| $a_8$ = 105° | 1.2588 | $d_8$ = 3.7764 inches |
| $a_9$ = 120° | 1.5000 | $d_9$ = 4.5000 inches |
| $a_{10}$ = 135° | 1.7071 | $d_{10}$ = 5.1213 inches |
| $a_{11}$ = 150° | 1.8660 | $d_{11}$ = 5.5980 inches |
| $a_{12}$ = 165° | 1.9659 | $d_{12}$ = 5.8977 inches |
| $a_{13}$ = 180° | 2.0000 | $d_{13}$ = 6.0000 inches |

By way of example, point 2 is derived from angle $a_2$ which falls in the second or third quadrant, and has a negative cosine. Angle $a_2$ equals fifteen degrees, and:

$$d_2 = ½(6)(1+COS15) = ½(6)(1-0.9659) = 0.1023 \text{ inches.}$$

Further, $d_{11}$ is derived from angle $a_{11}$ which falls in the first or fourth quadrant, and has a positive cosine. Angle $a_{11}$ equals 150°, and:

$$d_{11} = ½L(1+COSa_{11}) = ½(6)1+COS150) = ½(6)(1+COS30) = ½(6)(1+0.8660) = 5.5980 \text{ inches.}$$

It should, of course, be understood that a calibrated layout scale comprising any number of desired points may be derived by utilizing the general mathematical relationship:

$$d_n = ½L[1+COS(a_n)], \text{ wherein}$$

$d_n$ is the distance of each point $n$ from the end point of the scale and establishes the length of the corresponding element $n$ of the article.

From the foregoing, it will be apparent that the sheet pattern for any cylindrical article may be constructed utilizing the universal layout scale of FIG. 9 with or without the specific miter scale 70. Specifically, utilizing the layout scale and the teachings of the present invention, the gore pattern of FIGS. 11–13 may be generated as follows:

1. Miter angle $b$ is determined to be 11.25° and therefore;

$$m = (TAN b)k = (0.1989)(1 \text{ inch}) = 0.1989 \text{ inches}$$

2. stretch-out S is calculated, viz:

$$s = \pi(D) = \pi(7) = 22 \text{ inches;}$$

3. heel H is calculated, viz:

$$H = m(R+½D) = 0.1989(18+½(7) = 4.28 \text{ inches}$$

4. a piece of pattern material 75 large enough to readily accommodate heel H and stretch-out S is selected;
5. lines 88 and P are constructed and line M is constructed parallel to line P and a distance 4.28 inches therefrom;
6. line P is subdivided by normal lines 1—13—1 into a plurality of segments which collectively equal S, i.e., line P is 22 inches in length.
7. miter height V is calculated, viz:

$$V = mD = (0.1989)(7) = 1.39 \text{ inches;}$$

8. line Q is constructed parallel to line P and spaced upward therefrom a distance of 1.39 inches;
9. the universal layout scale 1–13 is placed with point 1 thereof on line Q and point 13 thereof on line P, afterwhich intersections (2,2)–(13,13) may be determined, as before; and
10. a smooth curve is drawn through the intersections and defines curve 34 of the gore.

It will be noted, therefore, that the sheet pattern for any cylindrical article may be constructed with the layout scale of the present invention when the quantity $m$ is known, and that $m$ may be provided by the miter scale 70 or may be calculated as disclosed herein. Further, the layout scale may be utilized to readily determine the length of the various elements of an article when the length of the longest and shortest elements thereof are known quantities.

Figure 16:
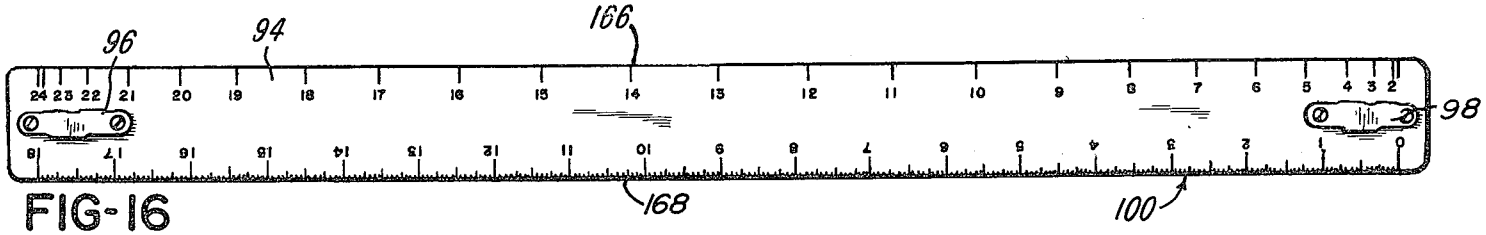
FIGS. 16–18 illustrate a modification of the layout instrument of the present invention adapted for use in combination with a standard mechanical drafting instrument.
Figure 17:
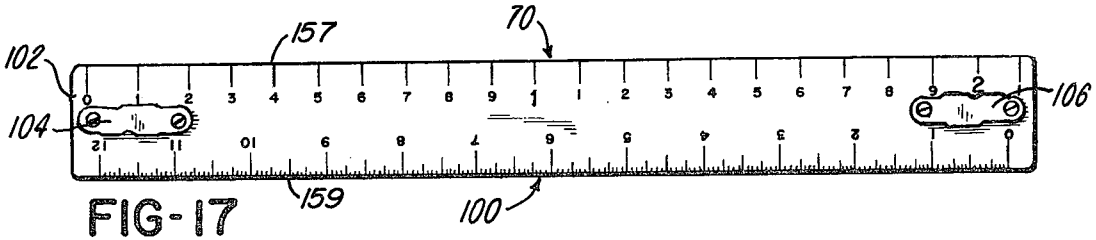
Figure 18:
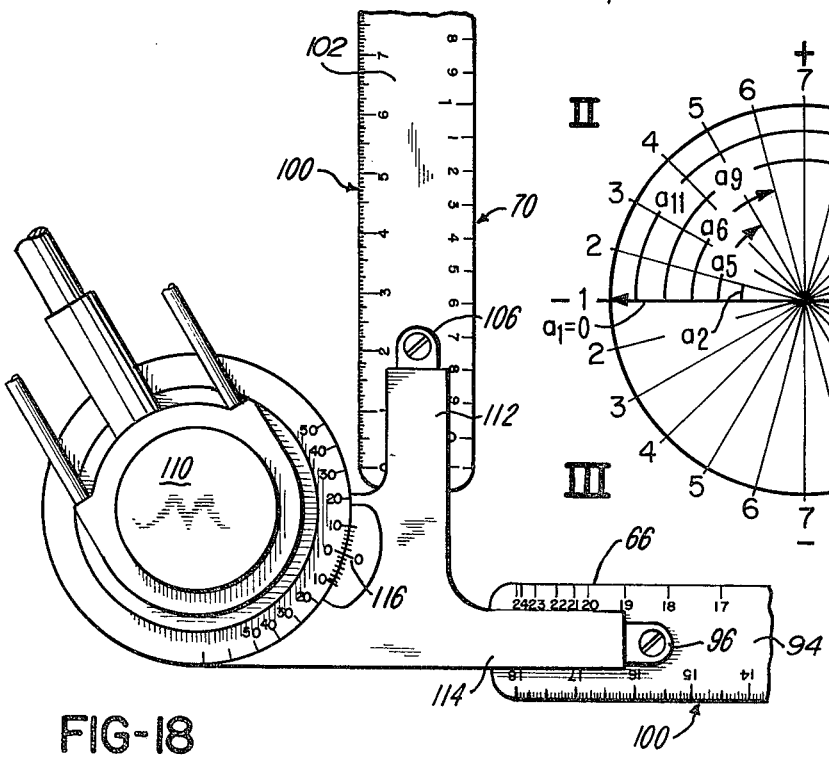

A modification of the layout instrument of the present invention is illustrated in FIGS. 16–18, wherein calibrated layout scale 1–25 and calibrated miter scale 70 of FIGS. 9 and 10, respectively, are each adapted to be used in conjunction with a typical mechanical drafting instrument 110.

As illustrated in FIG. 16, the calibrated layout scale 1–25 is placed adjacent longitudinal edge 166 of a standard draftng scale bar 94. Where desired, a standard full and half size scale 100 may be placed adjacent the opposite edge 168 thereof. The scale bar includes chucking plates 96 and 98 at either end thereof, each of which are adapted to be inserted in one of the plate receptive legs 112,114 of the drafting instrument 110 (FIG. 18).

As illustrated in FIG. 17, the calibrated miter scale 70 is placed adjacent longitudinal edge 157 of the drafting scale bar 102. Again, a typical full and half size scale 100 may be placed adjacent the other edge 159 thereof. Bar 102 also includes a pair of chucking plates 104 and 106, each of which are adapted to be received by one of the legs 112,114 of drafting instrument 110.

The specific angular relationship required to utilize the universal layout scale of FIGS. 16–18 may be established by the locking, adjustable angle plate 116 of the drafting instrument.

It should, of course, be understood that any of the miter and layout scales may be utilized in each of the several modifications of the present invention, wherein the scales are constructed and used according to the methods taught herein. Therefore, from the foregoing, it can be seen that I have provided a layout instrument and method of sheet-material fabrication, which provides for efficient and economical construction of cylindrical articles from flat pieces of sheet material. While the dimensions of the various examples illustrated herein are given in inches, it should, of course, be understood that the scale is readily adapted for use with other systems of linear measurement when the various dimensions of the final article are given in consistent units of measure.

What is claimed is:

1. A device for constructing the two-dimensional sheet pattern of a cylindrical article having a plurality of circumferentially spaced, longitudinal elements $n$ each having opposite ends which terminate in a first plane normal to the axis of the cylinder and a second, oblique plane which intersects the first plane at an acute angle, wherein each element $n$ is parallel to said axis and defines therewith an axial plane which intersects a diameter D of the cylinder at an angle $a_n$, and wherein the longest and shortest of said elements $n$ are of predetermined, ascertainable lengths, the device comprising: a calibrated layout scale bar of length L having a series of points thereon each spaced a distance $d_n$ from one end thereof defining that end of the corresponding element $n$ which is in the second, oblique plane, wherein:

$$d_n = \tfrac{1}{2}L(1+\mathrm{COS}a_n).$$

2. A device as called for in claim 1, which includes a miter scale bar comprising a series of equally spaced subdivisions thereon which define the length T of the said shortest element $n$ and the length H of the said longest element $n$ relative to the said acute angle, the diameter D of the cylinder, and a distance R from the intersection of the axis and the first plane to the intersection of the second plane and the first plane, wherein the length $m$ of each subdivision is the product of the tangent of said acute angle and one unit of linear measure, and wherein:

$$H = M(R+\tfrac{1}{2}D), \text{ and}$$

$$T = M(R-\tfrac{1}{2}D), \text{ respectively.}$$

3. A device as called for in claim 2, further comprising means for securely though releasably mounting said bars in fixed angular relationship with one another.

4. A device as called for in claim 3, wherein each scale bar is an elongate, substantially flat member having opposite, straight, parallel, longitudinal side-edges and an elongate, through slot having side walls parallel to and intermediate said side-edges, wherein the means last mentioned comprises an elongate fastener which is adapted to be inserted in said slot and forms a snug, slip-fit relationship with the said side walls thereof.

5. A device as called for in claim 4, wherein the miter scale bar terminates in a straight end-edge which is normal to the side-edges thereof, and wherein the initial subdivision of said scale is adjacent said end-edge.

6. A device as called for in claim 4, wherein the layout scale bar terminates in an arcuate end-portion which includes a calibrated protractor scale adjacent the outermost edge thereof.

7. A device as called for in claim 3, for use in combination with a mechanical drafting apparatus having a pair of orthogonally disposed, rotatable, scale-bar receptive legs, wherein each scale bar includes a chucking plate secured thereto, carried thereby and adapted to be received by one of the scale-bar-receptive legs of said drafting apparatus.

* * * * *